US011062640B2

(12) United States Patent
Li et al.

(10) Patent No.: US 11,062,640 B2
(45) Date of Patent: Jul. 13, 2021

(54) SCREEN DISPLAY METHOD AND SCREEN DISPLAY DEVICE

(71) Applicant: Beijing Xiaomi Mobile Software Co., Ltd., Beijing (CN)

(72) Inventors: Song Li, Beijing (CN); Hui Du, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/582,729

(22) Filed: Sep. 25, 2019

(65) Prior Publication Data

US 2020/0175909 A1 Jun. 4, 2020

(30) Foreign Application Priority Data

Nov. 30, 2018 (CN) ..... 201811455429.4

(51) Int. Cl.
*G09G 3/20* (2006.01)

(52) U.S. Cl.
CPC ... *G09G 3/2007* (2013.01); *G09G 2320/0233* (2013.01); *G09G 2380/02* (2013.01)

(58) Field of Classification Search
CPC .... G09G 3/20; G09G 2360/16; G09G 3/2007; G09G 3/2092; G09G 2320/0686; G09G 2320/0285; G09G 2320/0626; G09G 2320/0295; G09G 2320/0233; G09G 2380/02
See application file for complete search history.

(56) References Cited

U.S. PATENT DOCUMENTS

2015/0338888 A1* 11/2015 Kim ..... G06F 3/04886 345/156
2018/0059458 A1* 3/2018 Chen ..... G02F 1/134309
2018/0122302 A1 5/2018 Koong
(Continued)

FOREIGN PATENT DOCUMENTS

CN 1825421 A 8/2006
CN 106409206 A 2/2017
CN 107978264 A 5/2018
(Continued)

OTHER PUBLICATIONS

Extended European Search Report for European Application No. 19206207.3, dated Mar. 4, 2020.
(Continued)

*Primary Examiner* — Charles V Hicks
(74) *Attorney, Agent, or Firm* — Finnegan, Henderson, Farabow, Garrett & Dunner, L.L.P.

(57) ABSTRACT

A screen display method includes: determining, in a flexible display screen, a target display region in a display state when a foldable device is in a folded state; acquiring a target brightness difference value of each pixel unit in the target display region according to a position of the pixel unit in the target display region; adjusting a current brightness value of each pixel unit in the target display region according to the target brightness difference value of the pixel unit, to obtain an adjusted brightness value of each pixel unit in the target display region; and performing a screen display according to the adjusted brightness value of each pixel unit in the target display region.

14 Claims, 4 Drawing Sheets

(56) References Cited

U.S. PATENT DOCUMENTS

2018/0342192 A1* 11/2018 Lee ..... G09G 3/2007

FOREIGN PATENT DOCUMENTS

| | | | |
|---|---|---|---|
| CN | 108227897 | A | 6/2018 |
| CN | 108227996 | A | 6/2018 |
| JP | 2008-077005 | | 4/2008 |
| JP | 2015-038605 | | 2/2015 |
| JP | 2016-528532 | | 9/2016 |
| JP | 2017-003712 | | 1/2017 |
| JP | 2017142340 | A | 8/2017 |
| KR | 20040013617 | A | 2/2004 |
| KR | 20080047888 | A | 5/2008 |
| KR | 20180031893 | A | 3/2018 |
| RU | 2648635 | C2 | 3/2018 |

OTHER PUBLICATIONS

International Search Report for International Application No. PCT/CN2019/090516, dated Sep. 10, 2019.

Russian Office Action dated Aug. 6, 2020, in counterpart Russian Application No. 2019137977/07(074801).

English Translation of International Search Report issued by the State Intellectual Property Office (SIPO) of the People's Republic of China dated Sep. 10, 2019, in counterpart International Application No. PCT/CN2019/090516.

* cited by examiner

SCREEN DISPLAY METHOD AND SCREEN DISPLAY DEVICE

CROSS REFERENCE

This application is based upon and claims priority to Chinese Patent Application No. 201811455429.4, filed on Nov. 30, 2018, the entire contents thereof are incorporated herein by reference.

TECHNICAL FIELD

The present disclosure relates to the field of electronic technology, and more particularly to a screen display method and a screen display device.

BACKGROUND

With the development of electronic technology, users have put forward higher requirements for electronic devices, hoping that the display screen of an electronic device becomes larger and larger, and at the same time, the device can be easily carried. Foldable devices have been developed to meet user requirements.

A foldable device is equipped with a flexible display screen, which can be classified into an integrated circuit (IC) proximal end and an IC distal end according to a distance between a driving unit and the flexible display screen. When the driving unit illuminates the flexible display screen according to a preset reference brightness value, since a driving current has a certain loss during a transmission process, a current brightness value of the flexible display screen gradually decays from the IC proximal end to the IC distal end, thereby resulting in a problem of uneven brightness. In particular, when the foldable device is in a folded state, the load driven by the driving unit is reduced, and the problem of uneven brightness in a display region with a display state in the flexible display screen becomes particularly prominent. Therefore, in order to improve a screen display effect, a new screen display method is needed.

SUMMARY

According to a first aspect of embodiments of the present disclosure, a screen display method is provided, the method including: determining, in a flexible display screen, a target display region in a display state then a foldable device is in a folded state; acquiring a target brightness difference value of each pixel unit in the target display region according to a position of the pixel unit in the target display region; adjusting a current brightness value of each pixel unit in the target display region according to the target brightness difference value of the pixel unit, to obtain an adjusted brightness value of each pixel unit in the target display region; and performing a screen display according to the adjusted brightness value of each pixel unit in the target display region.

According to a second aspect of the embodiments of the present disclosure, a foldable device is provided, the foldable device including: a processor; a flexible display screen; and a memory configured to store instructions executable by the processor; wherein the processor is configured to: determine, in the flexible display screen, a target display region in a display state when the foldable device is in a folded state; acquire a target brightness difference value of each pixel unit in the target display region according to a position of the pixel unit in the target display region; adjust a current brightness value of each pixel unit in the target display region according to the target brightness difference value of the pixel unit, to obtain an adjusted brightness value of each pixel unit in the target display region; and perform a screen display according to the adjusted brightness value of each pixel unit in the target display region.

According to a third aspect of embodiments of the present disclosure, a non-transitory computer-readable storage medium has stored therein instructions that, when executed by a processor of a device, cause the device to perform a screen display method, the method including: determining, in a flexible display screen, a target display region in a display state when a foldable device is in a folded state; acquiring a target brightness difference value of each pixel unit in the target display region according to a position of the pixel unit in the target display region; adjusting a current brightness value of each pixel unit in the target display region according to the target brightness difference value of the pixel unit, to obtain an adjusted brightness value of each pixel unit in the target display region; and performing a screen display according to the adjusted brightness value of each pixel unit in the target display region.

The technical solution provided by the embodiments of the present disclosure may include the following beneficial effects.

The brightness value of each pixel unit in the target display region is adjusted according to the target brightness difference value of each pixel unit, by determining the target display region in the display state and acquiring the target brightness difference value of each pixel unit. Since the brightness value of each pixel unit after adjustment is the same, the brightness in the target display region after adjustment is uniform, and a screen display effect is better.

It shall be understood that the above general description and the following detailed description are merely exemplary and explanatory and are not intended to be restrictive of the present disclosure.

BRIEF DESCRIPTION OF THE DRAWINGS

The accompanying drawings, which are incorporated in and constitute a part of this specification, illustrate embodiments consistent with the invention, and together with the description, serve to explain the principles of the invention.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of devices and methods consistent with aspects related to the present disclosure as recited in the appended claims.

Figure 1:
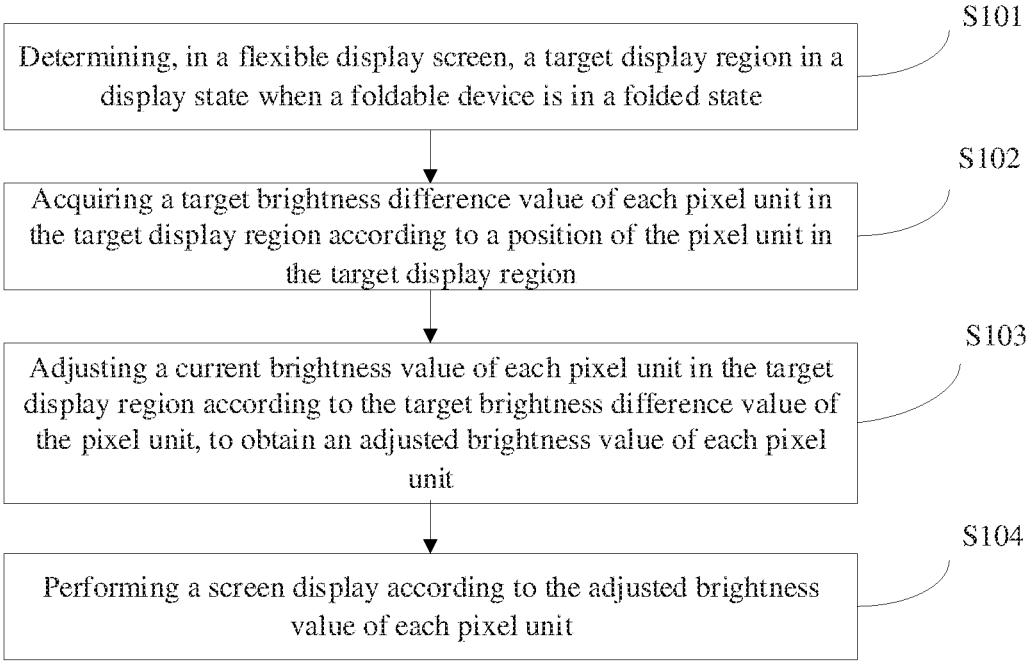
FIG. 1 is a flowchart of a screen display method according to an exemplary embodiment.

FIG. 1 is a flowchart diagram of a screen display method according to an exemplary embodiment. Referring to FIG. 1, the screen display method is used in a foldable device, and includes the following steps.

In step S101, when the foldable device is in a folded state, a target display region in a display state in a flexible display screen is determined.

In step S102, a target brightness difference value of each pixel unit in the target display region is acquired according to a position of the pixel unit in the target display region.

In step S103, a current brightness value of each pixel unit in the target display region is adjusted to obtain an adjusted brightness value of the pixel unit, according to the target brightness difference value of the pixel unit.

In step S104, a screen display is performed according to the adjusted brightness value of each pixel unit in the target display region.

The method provided by the embodiments of the present disclosure, by determining a display region in the display state, and acquiring a target brightness difference value of each pixel unit in the target display region, then, the brightness value of each pixel unit is adjusted according to the target brightness difference value. Since the adjusted brightness value of each pixel point is the same, brightness in the adjusted target display region is uniform, and the screen display effect becomes better.

In another embodiment of the present disclosure, acquiring the target brightness difference value of each pixel unit according to the position of the pixel unit in the target display region includes the following step: the target brightness difference value of each pixel unit is acquired according to a correspondence between the position of a pixel unit and the target brightness difference value, and the position of each pixel unit in the target display region.

In another embodiment of the present disclosure, before acquiring the target brightness difference value of each pixel unit according to the correspondence between the position of a pixel unit and the target brightness difference value and the position of each pixel unit in the target display region, the method further includes the follow steps: a maximum brightness difference value and a minimum brightness difference value in a preset target display region are acquired; a brightness difference curve is determined according to the maximum brightness difference value and the position thereof and the minimum brightness difference value and the position thereof, and the brightness difference curve is used to represent the correspondence between the position of the pixel unit and the brightness difference value.

In another embodiment of the present disclosure, before acquiring the target brightness difference value of each pixel unit according to the correspondence between the position of a pixel unit and the target brightness difference value and the position of each pixel unit in the target display region, the method further includes the follow step: the correspondence between the position and the brightness difference value of the pixel unit is preset.

In another embodiment of the present disclosure, adjusting the current brightness value of each pixel unit according to the target brightness difference value of each pixel unit to obtain the adjusted brightness value of each pixel unit includes the following steps: a sum of the current brightness value of each pixel unit and a corresponding target brightness difference value are acquired to obtain the adjusted brightness value of each pixel unit.

In another embodiment of the present disclosure, determining the target display region in the display state in the flexible display screen includes the following steps: a posture of the foldable device is acquired; and the target display region in the display state is determined according to the posture of the foldable device.

In another embodiment of the present disclosure, acquiring the posture of the foldable device includes the following steps: the posture of the foldable device is acquired by detecting the foldable device using a sensor, or the posture of the foldable device is acquired by using a camera to capture a face image of a user.

Any of the above technical solutions may be combined to form another embodiment of the present disclosure, and will not be further described herein.

Figure 2:
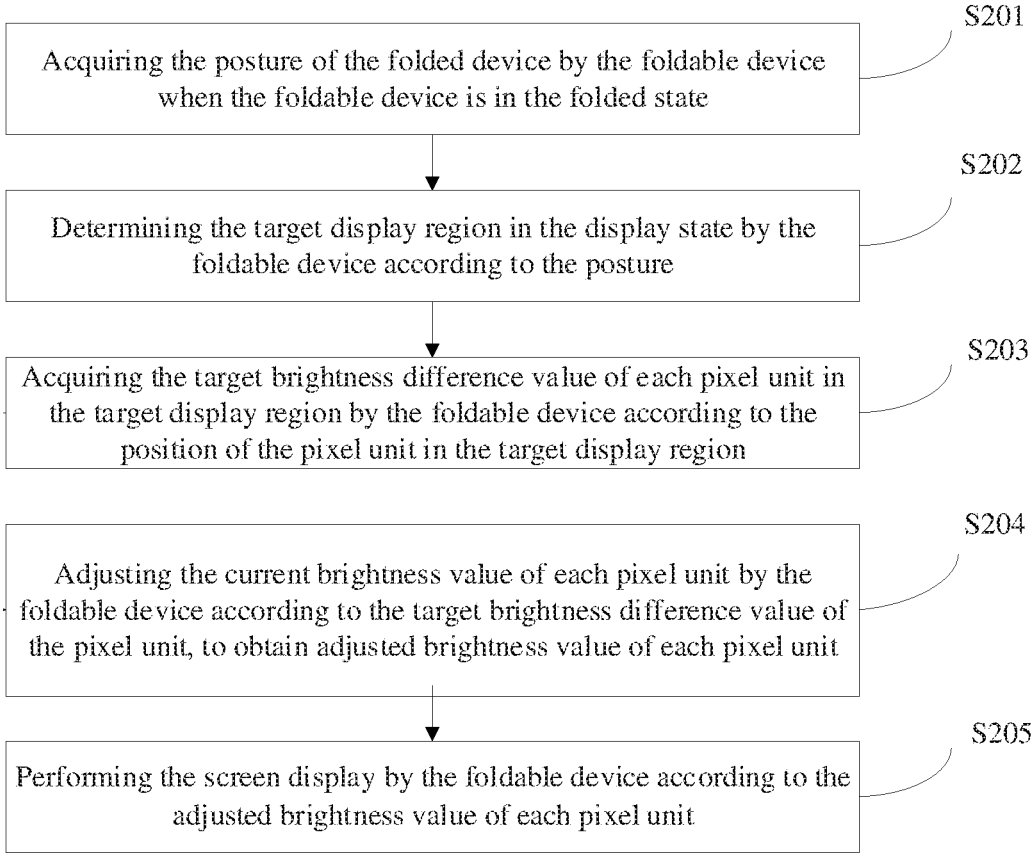
FIG. 2 is a flowchart of a screen display method according to an exemplary embodiment.

FIG. 2 is a flowchart diagram of a screen display method according to an exemplary embodiment. Referring to FIG. 2, the screen display method is used in the foldable device, and includes the following steps.

In step S201, when the foldable device is in the folded state, a posture of the folded device is acquired by the foldable device.

In the embodiment, the foldable device is provided with a foldable housing and a flexible display screen that can be folded or unfolded according to the user's requirements. When the foldable device is in an unfolded state, a larger display screen can be provided to meet a viewing requirement of the user. When the foldable device is in the folded state, an occupied space of the foldable device can be reduced to meet a portability requirement of the user. The foldable device may be a foldable smartphone, a tablet computer, a laptop computer, etc. The foldable device is not limited to the devices listed.

Typically, the flexible display screen includes a large number of light emitting diodes that consume a large amount of power and need to be driven by a driving unit to illuminate the flexible display screen. The driving unit may be a driving chip, or may be a central processing unit (CPU), etc. The flexible display screen includes an IC proximal end and an IC distal end in accordance with a distance between the flexible display screen and the driving unit. A display region including the IC proximal end is referred to as a first display region, and a display region including the IC distal end is referred to as a second display region. Considering that a driving current has a certain loss in a process of transmitting from the IC proximal end to the IC distal end, the brightness value of the first display region may be higher than the brightness value of the second display region, so that a problem of uneven brightness of the flexible display screen may exist. Moreover, the brightness value near the IC proximal end in the same display region is higher than the brightness value near the IC distal end, thereby resulting in the problem of uneven brightness also exists in the same display region. In order to solve the problem of uneven brightness in the flexible display screen and in the display region, the brightness value of each column of the pixel units in the flexible display screen and the display region is adjusted.

Considering that changes of brightness values in the first display region and the second display region are not consistent, different methods may be adopted to adjust the brightness values for different display regions. When the foldable device is in the folded state, the posture of the foldable device may to be acquired before adjusting the brightness values of each column of the pixel units in the display region. The posture of the foldable device includes the first display region being located above a screen of the second display region and the second display area being located above the screen of the first display region, etc.

In some embodiments, when the posture is acquired by the foldable device, the following methods may be used.

In a first method, various sensors such as a gravity sensor and a light sensor may be used by the foldable device to detect the foldable device. The posture of the foldable device is acquired by detecting the foldable device using sensors.

In a second method, the camera may be used by the foldable device to capture the face image of the user. The posture of the foldable device is acquired by using the camera to capture the face image of the user. For example, if the camera is located in the second display region, when the face image of the user is captured by the camera used by the foldable device, it may be determined that the second display region is located above the screen of the first display region. When the face image of the user is not captured by the camera used by the foldable device, it may be determined that the first display region is above the screen of the second display region. For the camera located in the first display region, the method for acquiring the posture of the foldable device is the same as the above method, and details are not described herein again.

In addition to the above two methods to acquire the posture of the foldable device, other methods may be used.

In step S202, the target display region in the display state is determined by the foldable device according to the posture.

When the acquired posture of the foldable device is that the first display region is located above the screen of the second display region, the first display region of the foldable device may be determined as the target display region in the display state. When the acquired posture of the foldable device is that the second display region is located above the screen of the first display region, the second display region of the foldable device may be determined as the target display region in the display state.

In step S203, the target brightness difference value of each pixel unit in the target display region is acquired by the foldable device according to the position of the pixel unit in the target display region.

In the embodiment, the target brightness difference value of each pixel unit is a difference between a reference brightness value and the current brightness value of the pixel unit. The current brightness value of the pixel unit is a brightness value when the pixel unit is illuminated before being adjusted. The preset brightness value is an ideal brightness value when each pixel unit preset by the foldable device is illuminated. Due to the loss of the driving current during the process of transmission and a load variation, when performing a progressive scan, the current brightness value of each pixel unit in each row of pixel units is inconsistent with the preset brightness value. The target brightness difference value of each of the pixel units is needed to be acquired, and then the brightness value of each of the pixel units is adjusted based on the target brightness difference value.

In the embodiments of the present disclosure, when the target brightness difference value of each pixel unit is acquired by the foldable device according to the position of the pixel unit in the target display region, the target brightness difference value of each pixel unit is acquired according to the correspondence between the position of the pixel unit and the target brightness difference value and the position of the pixel unit in the target display region. Specific embodiments include but not limited to the following two methods.

In the first method, a predetermined brightness difference curve is acquired by the foldable device, and the target brightness difference value of each pixel unit is determined according to the position and the brightness difference curve of the pixel unit in the target display region. In the embodiment, the brightness difference curve is provided to characterize the correspondence between the position and the brightness difference value of the pixel unit. Based on an acquired brightness difference curve, the foldable device can substitute the position of each pixel unit into the brightness difference curve, and the target brightness difference value of each pixel unit can be obtained by calculation.

Before the target brightness difference of each pixel unit in the target display region is acquired, the foldable device may need to determine the brightness difference curve. An exemplary process of determining the brightness difference curve is as follows.

In a first step, the maximum brightness difference value and the minimum brightness difference value in a preset target display region are acquired by the foldable device.

In the embodiment, the maximum brightness difference value is a maximum difference value between the foldable device after folding and before folding, and the minimum brightness difference value is a minimum difference value between the foldable devices after folding and before folding. The maximum brightness difference value and the minimum brightness difference value can be determined according to past experience or experimental data.

In a second step, the brightness difference curve is determined by the foldable device according to the maximum brightness difference value and the position thereof and the minimum brightness difference value and the position thereof.

The foldable device acquires an initial brightness difference curve that can be represented as a function between the position of the pixel unit and the brightness difference value, and an initial brightness difference includes a curve parameter to be determined. Based on acquired maximum brightness difference value and the position thereof and acquired minimum brightness difference value and the position thereof, the foldable device substitutes the maximum brightness difference value and the position thereof and the minimum brightness difference value and the position thereof into the initial brightness difference curve to obtain a curve parameter by fitting or other related calculations, and the initial brightness difference curve including the curve parameter is used as the brightness difference curve.

Further, in order to facilitate subsequent application of the brightness difference curve to acquire the target brightness difference value of each pixel unit in the target display region, the foldable device further stores a determined luminance difference curve, for example, the brightness difference curve may be stored in a CPU, or the brightness difference curve may be stored a driving chip.

In a second method, the correspondence between the position of preset pixel unit and the brightness difference value is acquired by the foldable device, and the target brightness difference value of each pixel unit is further determined according to the position of the pixel unit in the target display region and the correspondence between the position of the pixel unit and the brightness difference value.

Before acquiring the target brightness difference value of each pixel unit in the target display region, the foldable device may, according to the brightness value of the pixel unit collected when the target display region is in the display state and a preset reference brightness value, set a corresponding brightness difference value for the pixel unit to obtain the correspondence between the position of the pixel unit and the brightness difference value.

Further, in order to facilitate subsequent application of the correspondence between the position of the pixel unit and the brightness difference value to acquire the target brightness difference value of each pixel unit, the foldable device further stores the determined correspondence between the position of the pixel unit and the brightness difference value, for example, the correspondence may be stored in the CPU, or the correspondence may be stored in the driving chip.

In some embodiments, since the changes of the brightness values of the first display region and the second display region are not consistent, for the first display region and the second display region, the corresponding brightness difference curve or the correspondence between the position and the brightness difference value of the pixel unit may need to be separately determined. And brightness difference curves corresponding to the first display region and the second display region or the correspondence between the position and the brightness difference value of the pixel unit are respectively stored, so that when the foldable device is in different postures, the brightness value of the foldable device may be adjusted thereby obtaining a good viewing experience when the user views screen content in any of display regions.

In some embodiments, since the target brightness difference value of each pixel unit is a difference value between the preset brightness difference value and the current brightness value, for the pixel unit close to the driving unit, the current brightness value is increased due to a load reduction. The difference value between the preset brightness value and the current brightness value may be a negative value. For the pixel unit far from the driving unit, the brightness value is reduced due to the loss of the driving current during the process of transmission. However, as the load decreases, the brightness value is increased to some extent. Therefore, the difference value between the preset brightness value and the current brightness value may be a negative value, a positive value, or zero. In summary of the above analysis, the target brightness difference value in the embodiments of the present disclosure may be a positive value, a negative value, or zero.

In step S204, the current brightness value of each pixel unit in the target display region is adjusted by the foldable device according to the target brightness difference value of the pixel unit to obtain adjusted brightness value of the pixel unit.

When the target brightness difference value of each pixel unit is determined, the foldable device acquires a sum of the current brightness value and corresponding target brightness value of each pixel unit by adding the current brightness value and the corresponding target brightness value of each pixel unit. The sum of the current brightness value and the corresponding target brightness value of each pixel unit is further used as the adjusted brightness value of each pixel unit.

Since the loss of the driving current during the process of transmission and the change of the brightness value caused by the load reduction are taken into consideration when the target brightness difference value of each pixel unit is determined, when the current brightness value of each pixel unit is adjusted according to the target brightness difference value of each pixel unit, obtained adjusted brightness values of each pixel unit are the same, which are preset reference brightness values.

In step S205, the screen display is performed by the foldable device according to the adjusted brightness value of each pixel unit in the target display region.

Based on the adjusted brightness value of each pixel unit in the target display region, the screen display can be performed by the foldable device. Since the adjusted brightness value of each pixel unit is the preset reference brightness value, when the reference brightness value is used for the screen display, the brightness in the target display region is uniform, and the user can obtain a good viewing experience.

The method provided by the embodiments of the present disclosure adjusts the brightness value of each pixel unit in the target display region according to the target brightness difference value of the pixel unit, by determining the display region in the display state and acquiring the target brightness difference value of each pixel unit. Since the brightness value of each pixel point after adjustment is the same, the brightness in the target display region after adjustment is uniform, and the screen display effect is better.

Figure 3:
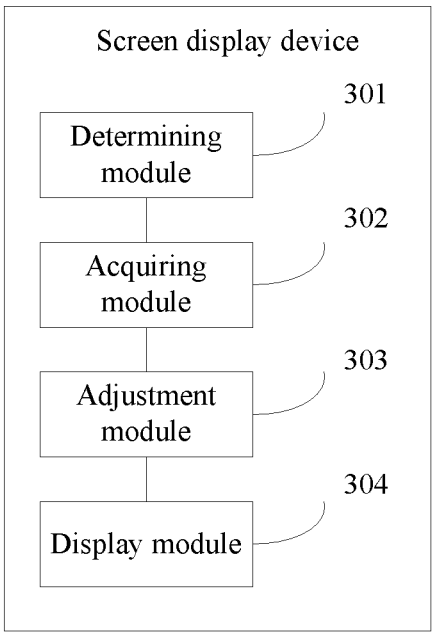
FIG. 3 is a block diagram of a screen display device according to an exemplary embodiment.

FIG. 3 is a block diagram of a screen display device according to an exemplary embodiment. The device includes a determining module 301, an acquiring module 302, an adjustment module 303, and a display module 304.

The determining module 301 is configured to determine the target display region in the display state in the flexible display screen when the foldable device is in the folded state.

The acquiring module 302 is configured to acquire the target brightness difference value of each pixel unit in the target display region according to the position of the pixel unit in the target display region.

The adjustment module 303 is configured to adjust the current brightness value of each pixel unit in the target display region according to the target brightness difference value of the pixel unit to obtain the adjusted brightness value.

The display module 304 is configured to perform the screen display according to the adjusted brightness value of each pixel unit in the target display region.

In another embodiment of the present disclosure, the acquiring module 302 is configured to acquire the target brightness difference value of each pixel unit according to the correspondence between the position of the pixel unit and the target brightness difference value and the position of the pixel unit in the target display region.

In another embodiment of the present disclosure, the acquiring module 302 is configured to acquire the maximum brightness difference value and the minimum brightness difference value in the preset target display region.

The determining module 301 is configured to determine the brightness difference curve by the foldable device according to the maximum brightness difference value and the position thereof and the minimum brightness difference value and the position thereof, and the brightness difference curve is provided to characterize the correspondence between the position and the brightness difference value of the pixel unit.

In another embodiment of the present disclosure, the device further includes a setting module. The setting module is configured to preset the correspondence between a position and a brightness difference value of a pixel unit.

In another embodiment of the present disclosure, the adjustment module 303 is configured to acquire the sum of the current brightness value and the corresponding target brightness value of each pixel unit to obtain the adjusted brightness value of the pixel unit.

In another embodiment of the present disclosure, the determining module 301 is configured to acquire the posture of the folded device and determine the target display region in the display state according the posture of the folded device.

In another embodiment of the present disclosure, the determining module 301 is configured to acquire the posture of the foldable device by detecting the foldable device using a sensor, or acquire the posture of the foldable device by using a camera to capture the face image of the user.

The device provided by the embodiments of the present disclosure adjusts the brightness value of each pixel unit according to the target brightness difference value of the pixel unit by determining the display region in the display state and acquiring the target brightness difference value of the pixel unit. Since the brightness value of each pixel unit after adjustment is the same, the brightness in the target display region after adjustment is uniform, and the screen display effect is better.

With regard to the device in the above embodiments, specific methods in which respective modules perform operations has been described in detail in the embodiments relating to the methods, and it will not be repeated herein.

Figure 4:
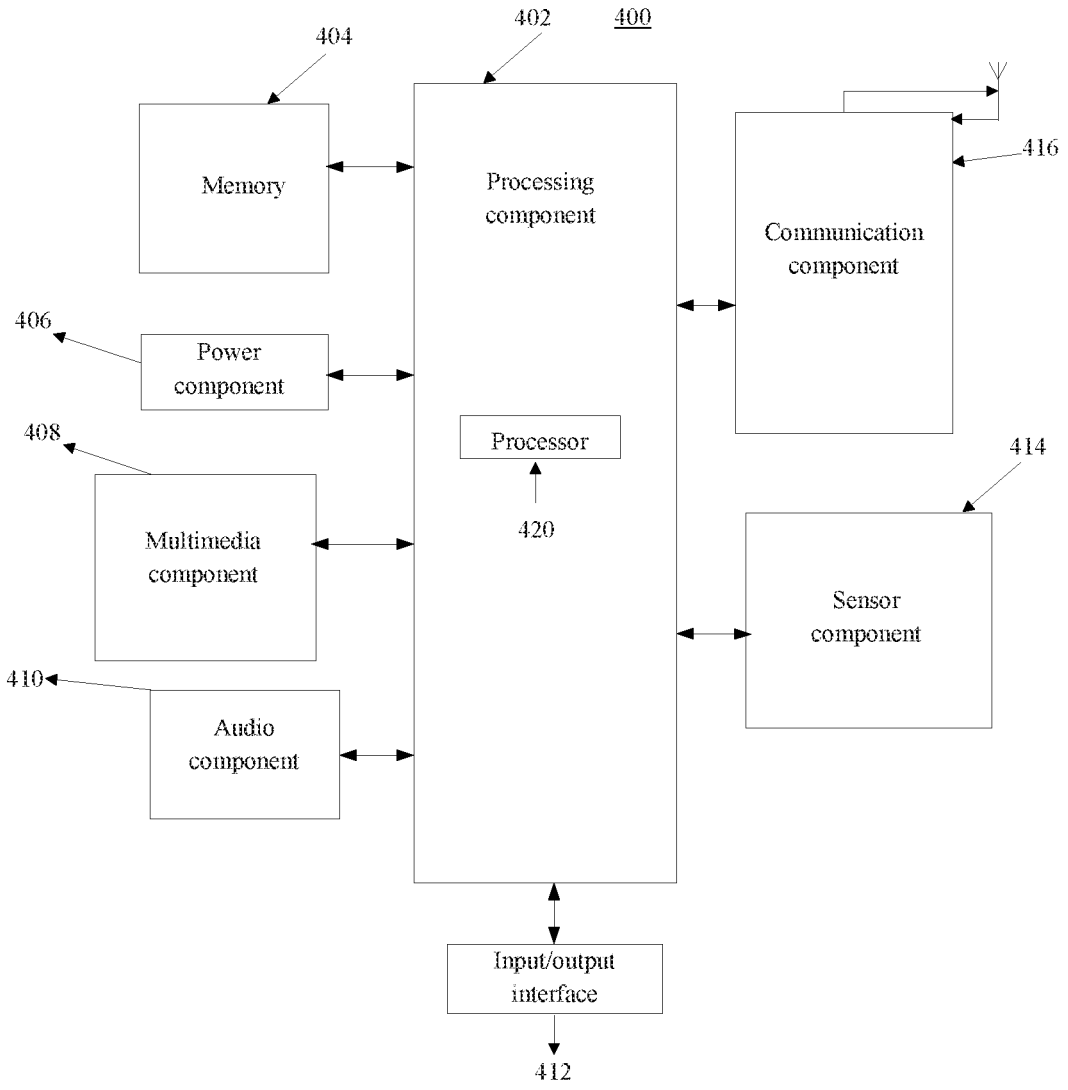
FIG. 4 is a block diagram of a screen display device according to an exemplary embodiment.

FIG. 4 is a block diagram of a screen display device 400 according to an exemplary embodiment. For example, the device 400 may be a foldable device, a mobile phone, a computer, a digital broadcast terminal, a message transceiver device, a game console, a tablet device, a medical equipment, a fitness equipment, a personal digital assistant, etc.

Referring to FIG. 4, the device 400 may include one or more of the following components: a processing component 402, a memory 404, a power component 406, a multimedia component 408, an audio component 410, an input/output (I/O) interface 412, a sensor component 414, and a communication component 416.

The processing component 402 typically controls overall operations of the device 400, such as the operations associated with display, telephone calls, data communications, camera operations, and recording operations. The processing component 402 may include one or more processors 420 to execute instructions to perform all or part of the steps in the above described methods. Moreover, the processing component 402 may include one or more modules which facilitate the interaction between the processing component 402 and other components. For instance, the processing component 402 may include a multimedia module to facilitate the interaction between the multimedia component 408 and the processing component 402.

The memory 404 is configured to store various types of data to support the operation of the device 400. Examples of such data include instructions for any applications or methods operated on the device 400, contact data, phonebook data, messages, pictures, video, etc. The memory 404 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory or a magnetic or optical disk.

The power component 406 provides power to various components of the device 400. The power component 406 may include a power management system, one or more power sources, and any other components associated with the generation, management, and distribution of power in the device 400.

The multimedia component 408 includes a screen providing an output interface between the device 400 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, slips, and gestures on the touch panel. The touch sensors may not only sense a boundary of a touch or slip action, but also sense a period of time and a pressure associated with the touch or slip action. In some embodiments, the multimedia component 408 includes a front camera and/or a rear camera. The front camera and the rear camera may receive an external multimedia data while the device 400 is in an operation mode, such as a photographing mode or a video mode. Each of the front camera and the rear camera may be a fixed optical lens system or have focus and optical zoom capability.

The audio component 410 is configured to output and/or input audio signals. For example, the audio component 410 includes a microphone configured to receive an external audio signal when the device 400 is in an operation mode, such as a call mode, a recording mode or a voice recognition mode. The received audio signal may be further stored in the memory 404 or transmitted via the communication component 416. In some embodiments, the audio component 410 further includes a speaker to output audio signals.

The I/O interface 412 provides an interface between the processing component 402 and peripheral interface modules such as a keyboard, a click wheel, buttons, and the like. The buttons may include, but are not limited to, a home button, a volume button, a starting button or a locking button.

The sensor component 414 includes one or more sensors to provide status assessments of various aspects of the device 400. For instance, the sensor component 414 may detect an open/closed status of the device 400, relative positioning of components, e.g., may be the display and the keypad of the device 400, may detect a change in position of the device 400 or a component of the device 400, a presence or absence of user contact with the device 400, an orientation or an acceleration/deceleration of the device 400 and a change in temperature of the device 400. The sensor component 414 may include a proximity sensor configured to detect the presence of nearby objects without any physical contact. The sensor component 414 may include a light sensor, such as a CMOS or CCD image sensor, for use in imaging applications as well. In some embodiments, the sensor component 414 may include an accelerometer sensor, a gyroscope sensor, a magnetic sensor, a pressure sensor, or a temperature sensor as well.

The communication component 416 is configured to facilitate communication, wired or wirelessly, between the device 400 and other devices. The device 400 can access a wireless network based on a communication standard, such as WiFi, 4G, or 5G, or a combination thereof. In one exemplary embodiment, the communication component 416 receives a broadcast signal or broadcast-associated information from an external broadcast management system via a broadcast channel. In one exemplary embodiment, the communication component 416 further includes a near field communication (NFC) module to facilitate short-range communications. In some embodiments, the communication component 416 may be realized based on a radio frequency identification (RFID) technology, an infrared data association (IrDA) technology, an ultra-wideband (UWB) technology, a Bluetooth (BT) technology or other technologies.

In exemplary embodiments, the device 400 may be realized with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors or other electronic components, for performing the method described above.

In exemplary embodiments, there is further provided a non-transitory computer-readable storage medium including instructions, such as the memory 404 including the instructions executable by the processor 420 in the device 400, for performing the above-described methods. For example, the non-transitory computer-readable storage medium may be a ROM, a RAM, a CD-ROM, a magnetic tape, a floppy disc, an optical data storage device, etc.

A non-transitory computer readable storage medium, when instructions in the storage medium are executed by a processor of a mobile terminal, may cause the mobile terminal to perform the screen display method.

The device provided by the embodiments of the present disclosure adjusts the brightness value of each pixel unit according to the target brightness difference value of the pixel unit by determining the target display region in the display state and acquiring the target brightness difference value of the pixel unit. Since the brightness value of each pixel unit after adjustment is the same, the brightness in the target display region after adjustment is uniform, and the screen display effect is better.

After considering this description and carrying out the embodiments disclosed herein, those skilled in the art may easily think of other implementations consistent with the present disclosure. The present disclosure is meant to cover any variations, usage or adaptive change of these embodiments, and these variations, usage or adaptive change follow general concept of the present disclosure and include the common knowledge or the customary technical means in the technical field that is not disclosed in the present disclosure. The description and embodiments are only exemplary, and the real range and spirit of the present disclosure are defined by the following claims.

It should be understood that the present disclosure is not limited to precise structures that are described above and shown in the accompanying drawings, and may be modified and changed without departing from the range of the present disclosure. The scope of the present disclosure is only defined by the appended claims.

What is claimed is:

1. A screen display method, comprising:

determining, in a flexible display screen, a target display region in a display state when a foldable device is in a folded state;

acquiring a maximum brightness difference value and a minimum brightness difference value in the target display region;

determining a brightness difference curve according to the maximum brightness difference value and a position of the maximum brightness difference value, and the minimum brightness difference value and a position of the minimum brightness difference value, wherein the brightness difference curve represents a correspondence between positions and brightness difference values of pixel units in the target display region;

acquiring a target brightness difference value of each pixel unit in the target display region according to a position of the pixel unit in the target display region and the correspondence represented by the brightness difference curve, wherein the target brightness difference value of each pixel unit in the target display region is a difference between a reference brightness value of the pixel unit and a current brightness value of the pixel unit, and the current brightness value of the pixel unit is a brightness value when the pixel unit is illuminated and is preset by the foldable device;

adjusting the current brightness value of each pixel unit in the target display region according to the target brightness difference value of the pixel unit, to obtain an adjusted brightness value of each pixel unit in the target display region; and performing a screen display according to the adjusted brightness value of each pixel unit in the target display region.

2. The method according to claim 1, before acquiring the target brightness difference value of each pixel unit in the target display region, further comprising:

presetting the correspondence between a position of a pixel unit and a brightness difference value.

3. The method according to claim 1, wherein adjusting the current brightness value of each pixel unit in the target display region, comprises:

acquiring a sum of the current brightness value and a corresponding target brightness difference value of each pixel unit in the target display region, to obtain the adjusted brightness value of each pixel unit.

4. The method according to claim 1, wherein determining, in the flexible display screen, the target display region in the displayed state, comprises:

acquiring a posture of the foldable device; and determining the target display region in the display state according the posture of the foldable device.

5. The method according to claim 4, wherein acquiring the posture of the folded foldable device comprises at least one of:

acquiring the posture of the foldable device by detecting the foldable device using a sensor; or acquiring the posture of the foldable device by using a camera to capture a face image of a user.

6. A foldable device, comprising:

a processor;

a flexible display screen; and a memory configured to store instructions executable by the processor;

wherein the processor is configured to:

determine, in the flexible display screen, a target display region in a displayed state when the foldable device is in a folded state;

acquire a maximum brightness difference value and a minimum brightness difference value in the target display region;

determine a brightness difference curve according to the maximum brightness difference value and a position of the maximum brightness difference value, and the minimum brightness difference value and a position of the minimum brightness difference value, wherein the brightness difference curve represents a correspondence between positions and brightness difference values of pixel units in the target display region;

acquire a target brightness difference value of each pixel unit in the target display region according to a position of the pixel unit in the target display region and the correspondence represented by the brightness difference curve, wherein the target brightness difference value of each pixel unit in the target display region is a difference between a reference brightness value of the pixel unit and a current brightness value of the pixel unit, and the current brightness value of the pixel unit is a brightness value when the pixel unit is illuminated and is preset by the foldable device;

adjust the current brightness value of each pixel unit in the target display region according to the target brightness difference value of the pixel unit, to obtain an adjusted brightness value of each pixel unit in the target display region; and perform a screen display according to the adjusted brightness value of each pixel unit in the target display region.

7. The foldable device according to claim 6, before acquiring the target brightness difference value of each pixel unit in the target display region, the processor is further configured to:

preset the correspondence between a position of a pixel unit and a brightness difference value.

8. The foldable device according to claim 6, wherein in adjusting the current brightness value of each pixel unit in the target display region, the processor is further configured to:

acquire a sum of the current brightness value and a corresponding target brightness difference value of each pixel unit in the target display region, to obtain the adjusted brightness value of each pixel unit.

9. The foldable device according to claim 6, wherein in determining, in the flexible display screen, the target display region in the displayed state, the processor is further configured to:

acquire a posture of the foldable device; and determine the target display region in the display state according the posture of the foldable device.

10. The foldable device according to claim 9, wherein in acquiring the posture of the foldable device, the processor is further configured to perform at least one of:

acquiring the posture of the foldable device by detecting the foldable device using a sensor; or acquiring the posture of the foldable device by using a camera to capture a face image of a user.

11. A non-transitory computer-readable storage medium having stored therein instructions that, when executed by a processor of a device, cause the device to perform a screen display method, the method comprising:

determining, in a flexible display screen, a target display region in a display state when a foldable device is in a folded state;

acquiring a maximum brightness difference value and a minimum brightness difference value in the target display region;

determining a brightness difference curve according to the maximum brightness difference value and a position of the maximum brightness difference value, and the minimum brightness difference value and a position of the minimum brightness difference value, wherein the brightness difference curve represents a correspondence between positions and brightness difference values of pixel units in the target display region;

acquiring a target brightness difference value of each pixel unit in the target display region according to a position of the pixel unit in the target display region and the correspondence represented by the brightness difference curve, wherein the target brightness difference value of each pixel unit in the target display region is a difference between a reference brightness value of the pixel unit and a current brightness value of the pixel unit, and the current brightness value of the pixel unit is a brightness value when the pixel unit is illuminated and is preset by the foldable device;

adjusting the current brightness value of each pixel unit in the target display region according to the target brightness difference value of the pixel unit, to obtain an adjusted brightness value of each pixel unit in the target display region; and performing a screen display according to the adjusted brightness value of each pixel unit in the target display region.

12. The non-transitory computer-readable storage medium according to claim 11, before acquiring the target brightness difference value of each pixel unit in the target display region, the method further comprising:

presetting the correspondence between a position of a pixel unit and a brightness difference value.

13. The non-transitory computer-readable storage medium according to claim 11, wherein adjusting the current brightness value of each pixel unit in the target display region, comprises:

acquiring a sum of the current brightness value and a corresponding target brightness difference value of each pixel unit in the target display region, to obtain the adjusted brightness value of each pixel unit.

14. The non-transitory computer-readable storage medium according to claim 11, wherein determining, in the flexible display screen, the target display region in the displayed state, comprises:

acquiring a posture of the foldable device; and determining the target display region in the display state according the posture of the foldable device.

* * * * *